United States Patent [19]

Chenel

[11] 4,226,063

[45] Oct. 7, 1980

[54] HERMETIC SEALS IN MULTIPLE PANE WINDOWS

[75] Inventor: Pierre Chenel, Enghien les Bains, France

[73] Assignee: Saint-Gobain Industries, Neuilly-sur-Seine, France

[21] Appl. No.: 639,786

[22] Filed: Dec. 11, 1975

[30] Foreign Application Priority Data

Dec. 11, 1974 [FR] France ..... 74 40827

[51] Int. Cl.[2] ..... E06B 7/12

[52] U.S. Cl. ..... 52/172; 52/788

[58] Field of Search ..... 52/171, 172, 616, 397, 52/396, 398, 788, 397, 389; 428/34

[56] References Cited

U.S. PATENT DOCUMENTS

| | | | |
|---|---|---|---|
| 3,265,765 | 8/1966 | Holden et al. | 260/5 |
| 3,733,237 | 5/1973 | Wolf | 52/397 |
| 3,758,996 | 9/1973 | Bowser | 52/304 |
| 3,775,914 | 12/1973 | Patil | 52/616 |
| 3,791,910 | 2/1974 | Bowser | 52/172 |
| 3,919,023 | 11/1975 | Bowser et al. | 52/616 |

FOREIGN PATENT DOCUMENTS

| | | | |
|---|---|---|---|
| 469518 | 11/1950 | Canada | 52/172 |
| 1268613 | 6/1961 | France | 52/393 |
| 1117028 | 6/1968 | United Kingdom | 52/172 |

*Primary Examiner*—James L. Ridgill, Jr.

*Attorney, Agent, or Firm*—Pennie & Edmonds

[57] ABSTRACT

A multiple pane window has an inner filamentary seal and an outer seal. The inner seal contains desiccant material whose concentration is greater in the inner portion thereof than in the outer portion thereof. The concentration may change progressively. The inner seal may comprise a plurality of layers with the concentration constant in each layer. Particular concentrations are given. Molecular sieves having absorption pores of about 4Å and 10Å may be employed, and the concentration of the 10Å pore sieves may be greater in the outer portion than in the inner portion of the inner seal.

3 Claims, 2 Drawing Figures

HERMETIC SEALS IN MULTIPLE PANE WINDOWS

Figure 1:
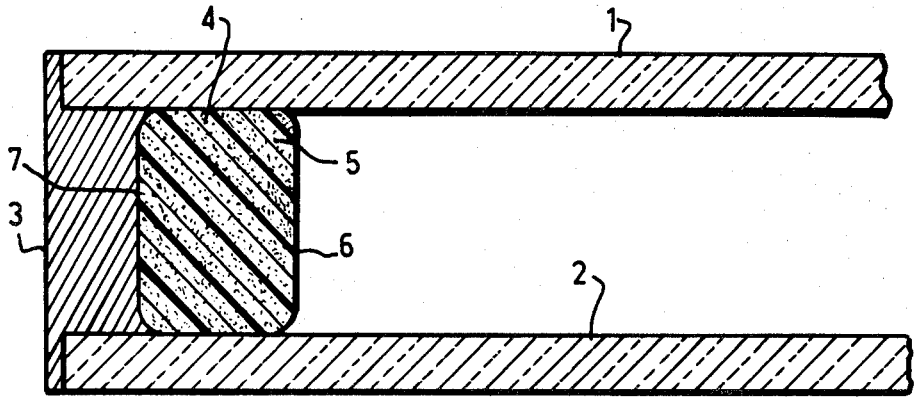

The present invention relates to a multiple pane insulating window, comprising at least two transparent or translucent sheets, for example of glass, separated by an intermediate seal of plastic material having desiccant material incorporated therein.

Multiple pane insulating windows are known having two or more sheets of a transparent or translucent material separated one from the other by intermediate seals or joints. The aforementioned sheets generally consist of glass and windows of glass will be referred to hereinafter although the invention is not limited thereto. The intermediate joints or seals have a dual function. Firstly, they are intended to seal the inner air spaces located between the sheets of glass by preventing the entry of vapors and dust from the outside air, and secondly, they are designed to keep the shects of glass in a given position and with given mutual spacing.

When these joints or seals are made of plastic material they comprise an inner filament made of a first plastic material such as polyisobutylene, and an outer mastic layer consisting of a second organic material such as a silicone or polysulfide elastomer. The inner filament acts to define the separation of the sheets and also as a seal between them, and generally contains a desiccant material which is designed to absorb any moisture trapped in the layer of air separating the two sheets of glass. The outer mastic layer keeps the unit in its correct position by virtue of its excellent adhesive properties while simultaneously ensuring watertightness. Multiple pane insulating windows of this type are described, for example, in U.S. Pat. Nos. 3,791,910 and 3,733,237 as well as in French Pat. No. 1,527,165.

In a known window the inner filament consists of two parts, one containing desiccant material and the other without desiccant. A window of this type is described in French Pat. No. 1,203,877. British Pat. No. 1,441,798 issued to the assignee hereof, describes an extruder for forming a composite filament of this type by simultaneously extruding two strands of the same composition based on a plastic material such as polyisobutylene. This mode of operation is suited to completely automatic production methods, for example, employing apparatus of the type described in U.S. Pat. No. 3,876,489 and U.S. applications Ser. Nos. 621,025, 621,026 and 622,539, all assigned to the assignee hereof.

The applicant has discovered that, in the course of time, certain agents may pass through the outer sealing layer, or certain solvents from the outer sealing layer may pass into the inner filamentary seal, and may cause loss of adhesion with consequent reduction in the effectiveness of the window.

The present invention makes it possible to produce a seal or joint having increased durability. The invention is characterized in that the inner filamentary seal comprises a desiccant material throughout its entire cross-section, and in that the concentration of the desiccant material increases between the outer edge and the inner edge of the inner seal. The concentration of the desiccant material is preferably between 5 and 15 percent by weight in the proximity of the outer edge and between 40 and 80 percent by weight in the proximity of the inner edge of the inner seal.

In one embodiment of the invention the concentration of desiccant in the zone extending from the outer edge to approximately the middle of the inner seal is constant and in the range of 5 to 15 percent by weight, and in the zone extending from approximately the middle of the seal to its inner edge it is constant and in the range of 40 to 80 percent by weight. In this embodiment the filamentary seal is extruded in the form of two juxtaposed layers which are discharged from the same extrusion nozzle.

In another embodiment, the filamentary seal may be extruded in the form of a larger number of juxtaposed layers such that the concentration of the desiccant increases progressively from the outer edge to the inner edge in a semicontinuous manner.

According to the preferred embodiment of the invention the desiccant material consists of a mixture of a molecular sieve having absorption pores of 4Å and of a molecular sieve having absorption pores of 10Å, the concentration of the molecular sieve having absorption pores of 10Å decreasing from the outer edge to the inner edge of the inner seal.

Figure 2:
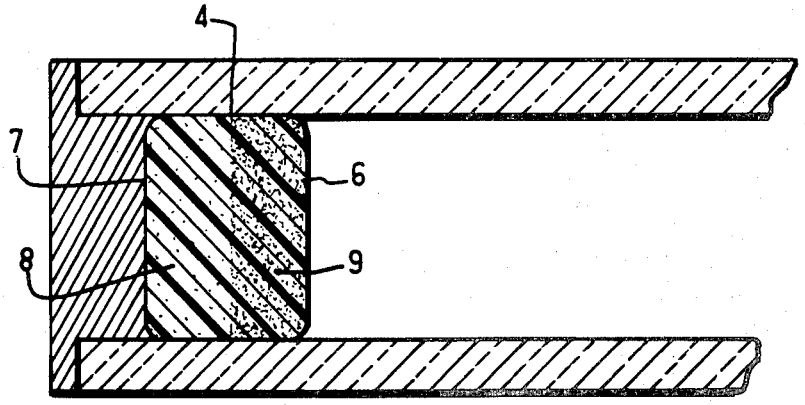

Other objects, features and advantages of the invention will be made apparent in the following description of preferred embodiments thereof in conjunction with the accompanying drawings in which:

FIG. 1 is a sectional view of a double pane insulating window wherein the concentration of the desiccant in the inner seal increases from the outer edge to the inner edge thereof; and FIG. 2 is a sectional view of a double pane insulating window wherein the concentration of the desiccant in the inner seal is relatively low and is constant from the outer edge to approximately the middle of the seal, and then increases and remains constant to the inner edge of the seal.

The double plane window shown in FIG. 1 comprises two sheets of glass 1 and 2 joined by seals according to the invention. These intermediate seals are formed in a manner known per se of an outer seal 3 and an inner filament 4.

The outer seal 3 consists of a mastic, generally with a polysulfide or silicone base. The outer layer is responsible for the mechanical stability of the window. It possesses a high modulus of elasticity and adheres well to the surface of the glass. It also possesses a certain degree of resistance to shearing effects which enables it to absorb relative movements of the sheets of glass 1 and 2 with respect to each other. These relative movements are produced by temperature differences (expansion), by exposure to mechanical stresses, for example, during transportation, or by differences in air pressure or the effect of wind.

The filament 4 comprises a polyisobutylene base having an average molecular weight, according to Staudinger, of 8,000–15,000, for example, the product sold under the trademark VISTANEX LMMS by Standard Oil of New Jersey. To the polyisobutylene are added Butyl rubber 268 of Standard Oil of New Jersey, and carbon black. A product such as Levilite may also be added, this consisting of pure precipitated silica having a granulometry lower than 7/1000 μm.

Filament 4 has a desiccant material incorporated within it, the desiccant being represented by the dots 5 in the drawings. The concentration of the desiccant in the proximity of the inner edge 6 is very high and may constitute 40 to 80 percent of the weight of the mixture. The desiccant is designed to absorb the moisture trapped in the air space between the sheets of glass. This percentage should produce moisture absorption of at least 0.12 g/ml per 24 hours at 20° C. with 100% relative humidity.

However, the applicant has discovered that, in the course of time, certain external agents may pass through the outer layer 3, or certain solvents from the outer layer 3 may move in the direction of the filament 4. This constitutes a serious disadvantage as the presence of these solvents can cause loss of adhesion. To obviate this disadvantage, the inner filament 4 comprises in the proximity of its outer edge 7 a quantity of the desiccant amounting to 5–15 percent of the mixture.

Accordingly, it will be noted that the inner filament 4 contains desiccant material throughout its entire cross-section and that the concentration of the desiccant increases from the outer edge 7 to the inner edge 6 of the cord. With the non-uniform concentration of desiccant in the base material, adequate adhesion of the inner seal to the glass sheets may be obtained, while at the same time effectively absorbing moisture from the inner air space, and the presence of desiccant in the outer zone will serve to absorb agents or solvents from the peripheral region and avoid possible loss of adhesion.

A filament of this type can be produced by extruding it in the form of a plurality of elementary juxtaposed layers discharged from the same extrusion nozzle. Advantageously, the drying agent or desiccant will consist of a mixture of molecular sieves having absorption pores of 4Å and of 10Å. In effect, the molecular sieve having absorption pores of 4Å selectively absorbs the water vapor, while the molecular sieve having pores of 10Å absorbs the solvents from the mastic of the outer layer 3, which comprise large molecules, and also any water vapor which is able to pass through the outer layer 3. For this reason, the concentration of the molecular sieve having absorption pores of 10Å is advantageously high in the proximity of the outer edge 7 and constitutes 5–15 percent by weight of the mixture, whereas it decreases to 0–10 percent in the proximity of the inner edge 6; the total concentration of the two types of molecular sieves increasing from the outer edge to the inner edge of the filament.

The molecular sieve could also consist exclusively of the sieve having absorption pores of 10Å. Its concentration would then vary from 5–15 percent in the proximity of the outer edge 7 to 40–80 percent in the proximity of the inner edge 6.

In the embodiment shown in FIG. 2 the inner filamentary seal 4 consists of two juxtaposed layers 8 and 9 extending between the glass sheets. The outer layer 8 includes a constant concentration of the desiccant of 5–15 percent by weight of the mixture over the zone extending from the outer edge 7 to the middle of the filament, whereas in the case of the inner layer 9 the concentration of the desiccant is also constant from the middle of the cord to its inner edge 6 but is 40–80 percent of the mixture. In the outer layer 8, the desiccant advantageously consists of a molecular sieve having absorption pores of 10Å whereas in the inner layer it consists of a molecular sieve having pores of 4Å.

It is also possible to employ exclusively a molecular sieve having absorption powers of 10Å, both in the inner layer 9 and in the outer layer 8, while retaining the concentrations given above.

By way of example, the following compositions yielded good results both for spacing the sheets of glass 1 and 2 and for seal tightness and absorption of water vapor and other agents, the compositions being given in percent by weight:

| | Outer Layer 8 | Inner Layer 9 |
|---|---|---|
| Polyisobutylene | 55 | 30 |
| Butyl rubber | 10 | 5 |
| Carbon black | 30 | 5 |
| Molecular sieve 10 Å | 5 | 5 |
| Molecular sieve 4 Å | 0 | 55 |

This filament was extruded using an extruder as described, for example, in British Pat. No. 2,207,799 supra.

As will be understood from the foregoing, the present invention provides a multiple pane window comprising a pair of transparent or translucent sheets arranged in generally parallel spaced relationship, an inner filamentary seal between said sheets adjacent the periphery thereof, and an outer seal encircling said inner seal and positioned to seal together the peripheral edges of said sheets, said inner filamentary seal having desiccant material incorporated therein throughout its cross-section with the concentration of the desiccant material substantially greater in the inner portion thereof than in the outer portion thereof. Preferably the concentration of the desiccant material in the proximity of the inner edge of said inner seal is 40 to 80 percent by weight and in the proximity of the outer edge thereof is 5 to 15 percent by weight. The concentration of the desiccant material may increase progressively from the outer edge to the inner edge of the inner seal. The inner seal may comprise a plurality of juxtaposed layers each extending between said sheets, the concentration of said desiccant material in said layers increasing from the outer layer to the inner layer. Further features of the invention are described in connection with the examples given hereinbefore.

I claim:

1. A multiple pane window comprising a pair of transparent or translucent sheets arranged in generally parallel spaced relationship, an inner filamentary seal of plastic material between said sheets adjacent the periphery thereof, and an outer seal encircling said inner seal and positioned to seal together the peripheral edges of said sheets, and inner filamentary seal having desiccant material comprising a mixture of molecular sieves having absorption pores of about 4Å and of about 10Å respectively incorporated therein throughout its cross-section with the concentration of the desiccant material substantially greater in the inner portion thereof than in the outer portion thereof.

2. A window according to claim 1 in which the concentration of the molecular sieve having absorption pores of about 10Å is greater in the outer portion of the inner seal than in the inner portion thereof.

3. A window according to claim 2 in which the concentration of the molecular sieve having absorption pores of about 10Å is in the range of 5 to 15 percent by weight in the portion of the inner seal in proximity to the outer edge thereof and in the range of 0 to 10 percent by weight in the portion in proximity to the inner edge thereof.

* * * * *